US012239898B1

(12) United States Patent
Malos

(10) Patent No.: US 12,239,898 B1
(45) Date of Patent: Mar. 4, 2025

(54) CARBON FIBER SNOWBOARD

(71) Applicant: Dennis Malos, Ridgefield, CT (US)

(72) Inventor: Dennis Malos, Ridgefield, CT (US)

( * ) Notice: Subject to any disclaimer, the term of this patent is extended or adjusted under 35 U.S.C. 154(b) by 0 days.

(21) Appl. No.: 18/934,078

(22) Filed: Oct. 31, 2024

(51) Int. Cl.
*A63C 5/03* (2006.01)
*A63C 5/12* (2006.01)

(52) U.S. Cl.
CPC ..... *A63C 5/03* (2013.01); *A63C 5/124* (2013.01); *A63C 5/126* (2013.01)

(58) Field of Classification Search
CPC ..... A63C 5/03; A63C 5/124; A63C 5/126; B32B 27/08; B32B 7/12; B32B 2260/046; B32B 2262/101; B32B 27/32; B32B 2260/021; B32B 2266/025; B32B 5/26; B32B 27/12; B32B 2262/106; B32B 3/263; B32B 37/153; B32B 2250/03; B32B 21/14; B32B 2260/023; B32B 2323/043; B32B 2260/026; B32B 2323/04
See application file for complete search history.

(56) References Cited

U.S. PATENT DOCUMENTS

| | | | | |
|---|---|---|---|---|
| 4,679,814 | A | 7/1987 | Meatto et al. | |
| 5,948,472 | A | 9/1999 | Lawrie | |
| 6,886,848 | B2 | 5/2005 | Riepler | |
| 7,314,227 | B2 * | 1/2008 | Sanders | A63C 5/03 280/14.22 |
| 7,316,411 | B2 | 1/2008 | Spanier et al. | |
| 9,744,430 | B2 * | 8/2017 | Hill | B32B 5/26 |
| 2004/0183269 | A1 * | 9/2004 | Hadzicki | A63C 5/12 280/87.042 |
| 2005/0121881 | A1 * | 6/2005 | Ambuske | A63C 5/12 280/610 |
| 2011/0206895 | A1 | 8/2011 | Turner et al. | |
| 2014/0062064 | A1 * | 3/2014 | Kilchenstein | B32B 15/20 280/610 |
| 2015/0042074 | A1 | 2/2015 | Fumagalli | |
| 2021/0339113 | A1 * | 11/2021 | Ekker | B32B 3/263 |

FOREIGN PATENT DOCUMENTS

| | | | | |
|---|---|---|---|---|
| FR | 2942413 A1 * | 8/2010 | | A63B 69/0093 |
| WO | WO-2011009627 A1 * | 1/2011 | | B32B 21/08 |

OTHER PUBLICATIONS

FR-2942413-A1 English Translation (Year: 2010).*
WO-2011009627-A1 English Translation (Year: 2011).*

* cited by examiner

*Primary Examiner* — James A Shriver, II
*Assistant Examiner* — Michael T. Walsh
(74) *Attorney, Agent, or Firm* — Gugliotta & Gugliotta LPA

(57) ABSTRACT

A snowboard incorporating advanced materials and innovative construction techniques provides superior performance in terms of weight, durability, flexibility, and speed. The snowboard features a top layer of exposed carbon fiber, an aspen wood core reinforced with carbon fiber strips, a bottom layer of carbon fiber beneath a sintered base layer, and edges constructed from titanium. The strategic use of carbon fiber layers bonded with reduced epoxy enhances flexibility while maintaining structural integrity. The sintered base layer effectively absorbs wax to reduce resistance and increase speed. Titanium edges maintain sharpness, resist rust, and reduce overall weight compared to steel edges. This combination of materials and construction techniques creates a versatile snowboard that addresses common issues such as cracking and splitting while excelling in various snowboarding conditions.

15 Claims, 2 Drawing Sheets

CARBON FIBER SNOWBOARD

RELATED APPLICATIONS

There are no previously filed, nor currently any co-pending applications, anywhere in the world.

BACKGROUND OF THE INVENTION

1. Field of the Invention

The present invention relates generally to snowboards and, more particularly, to a snowboard constructed with advanced materials such as carbon fiber and titanium, designed to provide superior performance in terms of weight, durability, flexibility, and speed.

2. Description of the Related Art

Traditional snowboards are often constructed using materials and methods that result in boards which are heavy, less durable, and lack the necessary flexibility for optimal performance. Common issues include cracking, fracturing, and splitting, especially in boards that use bamboo cores and steel edges. Additionally, base layers in traditional snowboards, typically made from extruded plastic, offer lower wax absorption and higher resistance, impacting the board's speed and control.

Existing snowboards also often focus on specific styles of snowboarding, such as park, freeride, or powder, making it difficult to find a versatile board that excels in all conditions. The use of materials like steel for edges adds unnecessary weight and can rust, reducing the board's longevity and performance.

Some reveals several skis and snowboards incorporating composite materials such as carbon fiber, as well as metal edges and specialized base layers. For example:

U.S. Pat. No. 6,886,848 issued in the name of Riepler, shows the use of carbon fibers layers laminated to a core;

U.S. Pat. No. 7,316,411 issued in the name of Spanier et al., shows wood cores made of materials like aspen, and specialized base layers for enhanced gliding properties; and U.S. Patent Application Publication No. 2014/0062064, published in the name of Kilchenstein et al, teaches metal edges for durability and edge control.

However, none of these or other prior art address persistent issues such as cracking, fracturing, and splitting and, through extensive trial and error, a specific configuration that solves these problems with enhanced flexibility without compromising durability were not readily apparent. Therefore, there is a need for a snowboard that addresses these issues by providing a lightweight, durable, flexible, and versatile design using advanced materials and innovative construction techniques.

SUMMARY OF THE INVENTION

It is thus an object of the present invention to provide a snowboard and method of its construction to provide superior performance in terms of weight, durability, flexibility, and speed.

It is a feature of the present invention to provide a combination of a top carbon fiber layer, aspen wood core reinforced with carbon fiber, bottom carbon fiber layer beneath a sintered base, and titanium edges that provides the optimal balance of lightweight construction, durability, flexibility and performance.

Briefly described according to the preferred embodiment of the present invention, a snowboard is provided that incorporates advanced materials and innovative construction techniques to provide superior performance in terms of weight, durability, flexibility, and speed. The snowboard features a top layer of exposed carbon fiber, an aspen wood core reinforced with carbon fiber strips, a bottom layer of carbon fiber beneath a sintered base layer, and edges constructed from titanium.

The strategic use of carbon fiber layers bonded with reduced epoxy and fiber enhances the board's flexibility while maintaining structural integrity. The sintered base layer is designed to absorb wax more effectively than traditional extruded bases, reducing resistance and increasing speed. The titanium edges maintain sharpness, resist rust, and reduce the overall weight of the board compared to steel edges.

It is an advantage of the present invention that it provides a significantly lighter snowboard, enhancing maneuverability and control.

It is another advantage of the present invention that it incorporates carbon fiber layers, ensuring superior durability and strength.

It is an advantage of the present invention that it utilizes an aspen wood core reinforced with carbon fiber strips, providing an optimal balance of weight and flexibility.

It is another advantage of the present invention that it features a sintered base layer, which offers higher wax absorption and reduces resistance for better gliding and increased speed.

It is an advantage of the present invention that it employs titanium edges, which maintain sharpness, resist rust, and reduce weight, enhancing overall control and performance.

It is another advantage of the present invention that it combines innovative materials and construction techniques to create a versatile snowboard capable of excelling in various snowboarding styles and conditions.

It is an advantage of the present invention that it addresses common issues such as cracking, fracturing, and splitting, ensuring a longer lifespan and reliable performance.

It is another advantage of the present invention that it provides enhanced speed and control, offering a superior riding experience compared to traditional snowboards.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
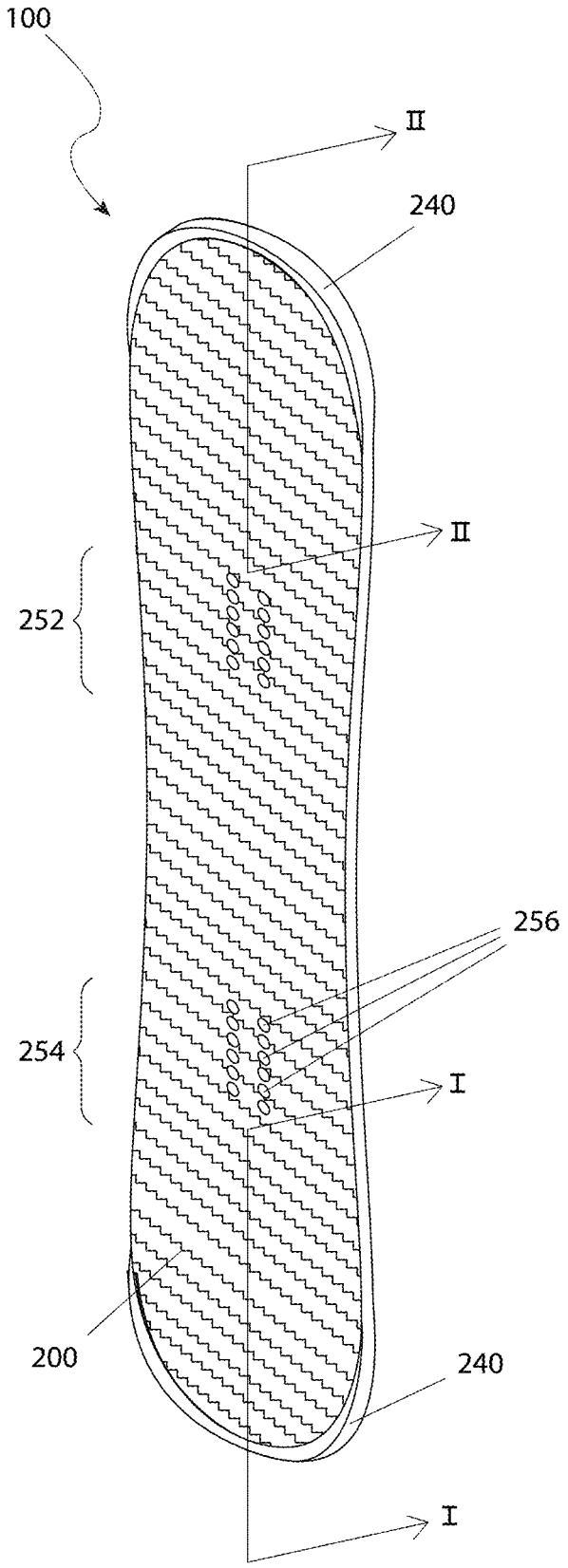
FIG. 1 is an isometric view of a carbon fiber snowboard 100, according to an embodiment of the present invention.
Figure 2:
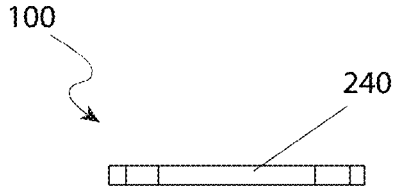
FIG. 2 is an end view of the carbon fiber snowboard 100, according to an embodiment of the present invention.
Figure 3:
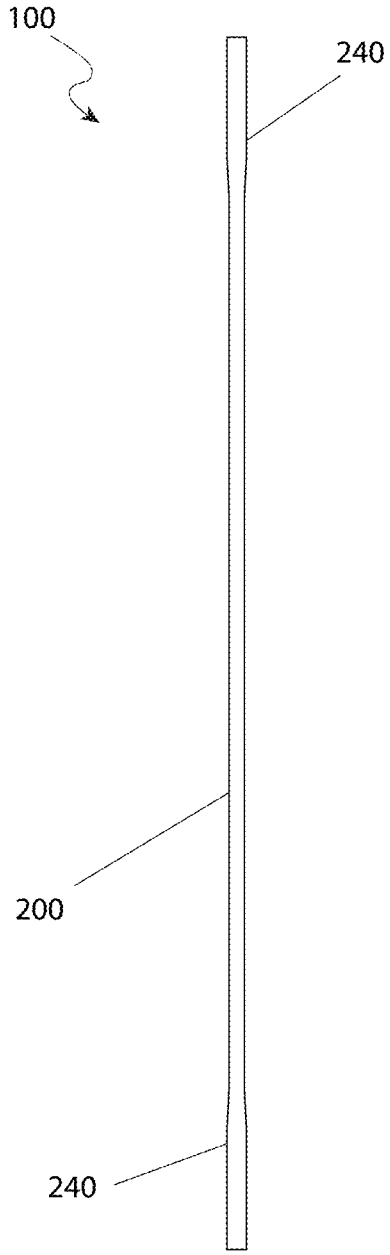
FIG. 3 is a side view of the carbon fiber snowboard 100, according to an embodiment of the present invention.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, the present invention is directed to a carbon fiber snowboard (herein described as the "snowboard") 100. The snowboard 100 may comprise a carbon fiber layer 200, a wood core 210, a sintered base layer 230, and a pair of reinforced edges 240. Other embodiments may provide for a carbon fiber support layer 212. The carbon fiber layer 200, the wood core 210, and the sintered base layer 230 may be bonded together to form a snowboard 100 having an oblong footprint. The snowboard 100 may be adapted for a user to stand upon while descending a slope covered by snow. The carbon fiber layer 200 may be positioned above the wood core 210. The sintered base layer 230 may be bonded to the bottom of the wood core 210. The reinforced edges 240 may surround the snowboard 100 at the ends thereof to protect the snowboard from damage.

The carbon fiber layer 200 may be made of carbon fiber, a composite of epoxy and crystalline filaments of carbon. The carbon fiber layer 200 may strengthen the snowboard 100 without adding significant weight. The carbon fiber layer 200 may be bonded directly to the top of the wood core 210. The carbon fiber layer 200 may be the topmost layer of the snowboard 100. The wood core 210 may strengthen the snowboard 100 and may flex, thereby contributing to the responsiveness of the snowboard 100 during use. In a preferred embodiment, the wood core 210 may be made from aspen.

Figure 4A:
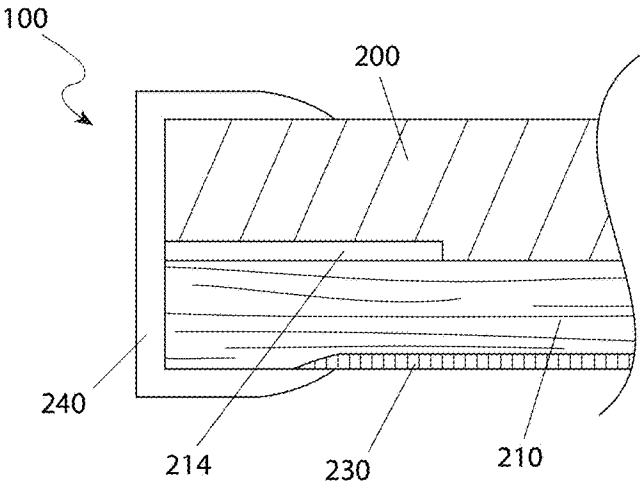
FIG. 4*a* is a cross-sectional view of a first end of the carbon fiber snowboard 100 along the line I-I (see FIG. 1), according to an embodiment of the present invention.
Figure 4B:
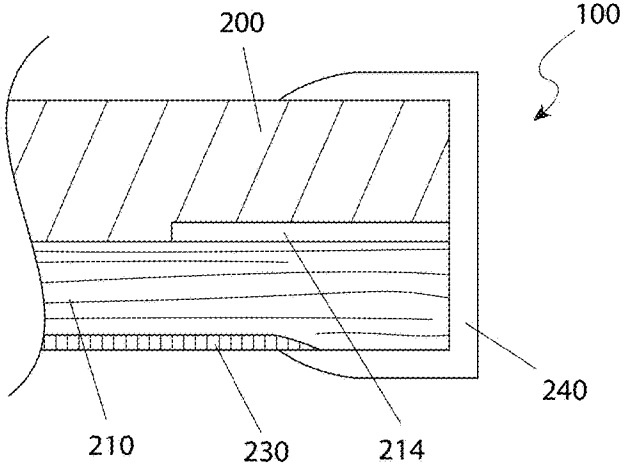
FIG. 4*b* is a cross-sectional view of a second end of the carbon fiber snowboard 100 along the line II-II (see FIG. 1), according to an embodiment of the present invention.

In some embodiments, the wood core 210 may comprise a fiberglass support 214 at both ends. The fiberglass support 214 may be a first fiberglass cap bonded to a first top end of the wood core 210 and a second fiberglass cap bonded to a second top end of the wood core 210 (please see FIGS. 4*a*, 4*b*).

Figure 5A:
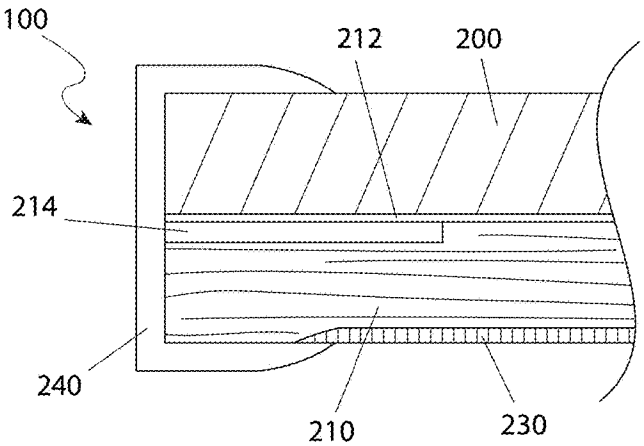
FIG. 5*a* is a cross-sectional view of a first end of the carbon fiber snowboard 100 along the line I-I (see FIG. 1), according to an alternative embodiment of the present invention, illustrating the carbon fiber support layer; and, FIG. 5*b* is a cross-sectional view of a second end of the carbon fiber snowboard 100 along the line II-II (see FIG. 1), according to an alternative embodiment of the present invention, illustrating the carbon fiber support layer.
Figure 5B:
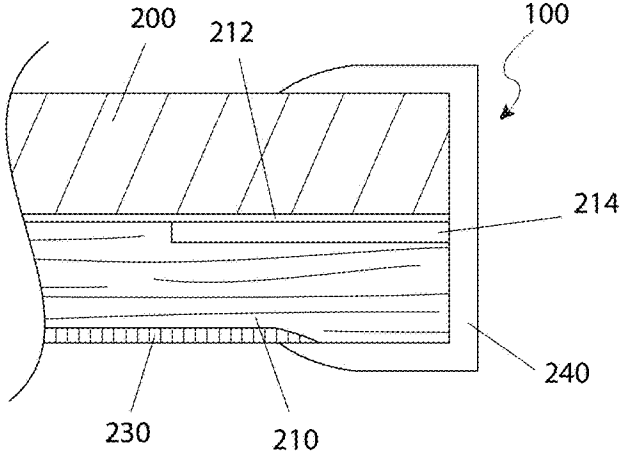

In some embodiments, the wood core 210 may comprise a carbon fiber support layer 212 that is bonded to the top of the wood core 210 and the fiberglass support 214 to reinforce the wood core 210. As a non-limiting example, the carbon fiber support layer 212 may comprise carbon fiber strips bonded to the wood core 210 with epoxy (please see FIGS. 5*a*, 5*b*).

The sintered base layer 230 may be bonded to the bottom of the wood core 210. The sintered base layer 230 may be the bottommost layer of the snowboard 100. The sintered base layer 230 may be formed from plastic pellets that are heated and pushed together under pressure. The sintered base layer 230 may be porous and may therefore absorb wax very effectively. The wax absorbed by the sintered base layer 230 may reduce resistance and therefore increase the speed of the snowboard 100. As a non-limiting example, the sintered base layer 230 may be made by sintering polyethylene pellets. The reinforced edges 240 may surround the snowboard 100 to protect the first and second ends of the carbon fiber layer 200, the wood core 210, any fiberglass support 214 or carbon fiber support layer 212, and the sintered base layer 230 from damage. Titanium is a preferred choice for the reinforced edges 240 because titanium is strong, lighter than steel, and corrosion resistant.

In some embodiments, the snowboard 100 may use a reduced epoxy in the carbon fiber layer 200, the carbon fiber support layer 212, or any combination thereof. The reduced epoxy may utilize an epoxy thinner as a solvent to reduce the viscosity of the epoxy. The reduced epoxy may enhance the ability of the snowboard 100 to flex during use.

The snowboard 100 may comprise a front binding mount 252 and a rear binding mount 254. The front binding mount 252 may be located on the top of the front half of the snowboard 100 and the rear binding mount 254 may be located on the top of the rear half of the snowboard 100. An individual binding mount 252, 254 may comprise a plurality of threaded inserts 256 that may be operable to hold bindings to the snowboard 100.

2. Operation of the Preferred Embodiment

In operation the bindings may be coupled to the top of the snowboard 100 at the front binding mount 252 and the rear binding mount 254. Wax may be applied to the sintered base layer 230 on the bottom of the snowboard 100 to reduce friction. The user may couple their feet into the bindings and may stand sideways above the snowboard 100 with a first foot in front of the other second foot. The user may ride the snowboard 100 down a slope by balancing their weight above the snowboard 100 and by shifting their weight to guide the snowboard 100.

The exact specifications, materials used, and method of use of the snowboard 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The development of the present invention involved an extensive process of experimentation and refinement to identify the optimal combination of materials and construction techniques. Numerous prototypes were created, each with variations in the type and arrangement of core materials, fiber layers, base materials, and edge constructions. These prototypes were subjected to rigorous testing in various snowboarding conditions to evaluate their performance in terms of weight, flexibility, durability, and speed. Through this iterative process, it was discovered that the specific combination of a top carbon fiber layer, an aspen wood core reinforced with carbon fiber strips, a bottom carbon fiber layer beneath a sintered base, and titanium edges provided the best balance of desired characteristics.

This unique combination of materials and construction methods addresses common issues found in traditional snowboards, such as cracking, fracturing, and splitting, while providing a lightweight, durable, and versatile board that excels in various snowboarding styles and conditions. The result is a snowboard that offers enhanced speed, control, and overall performance, delivering a superior riding experience for snowboarding enthusiasts.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this patent application.

What is claimed is:

1. A snowboard comprising:

a carbon fiber layer positioned as a topmost layer;

a wood core bonded directly beneath said carbon fiber layer;

a sintered base layer bonded to a bottom of said wood core, wherein said sintered base layer comprises sintered polyethylene pellets; and a pair of reinforced edges surrounding the ends of said snowboard.

2. The snowboard of claim 1, wherein said wood core comprises:

a first fiberglass cap bonded to a first top end of said wood core; and a second fiberglass cap bonded to a second top end of said wood core.

3. The snowboard of claim 2, further comprising:

a carbon fiber support layer bonded to the top of said wood core and said first and second fiberglass caps.

4. The snowboard of claim 3, wherein said carbon fiber support layer comprises:

carbon fiber strips bonded to said wood core with epoxy.

5. The snowboard of claim 1, wherein said wood core comprises aspen wood.

6. The snowboard of claim 1, wherein said carbon fiber layer comprises:

reduced epoxy utilizing an epoxy thinner as a solvent to reduce viscosity and enhance flexibility during use.

7. The snowboard of claim 1, further comprising:

a front binding mount located on a top of a front half of said snowboard; and a rear binding mount located on a top of a rear half of said snowboard.

8. The snowboard of claim 7, wherein each of said front binding mount and said rear binding mount comprises:

a plurality of threaded inserts operable to hold bindings to said snowboard.

9. The snowboard of claim 1, wherein said reinforced edges comprise titanium.

10. The snowboard of claim 1, wherein said sintered base layer is porous to enhance wax absorption for reducing resistance during use.

11. A method of manufacturing a snowboard comprising:

bonding a carbon fiber layer directly to a top of a wood core;

bonding a sintered base layer to a bottom of said wood core;

attaching reinforced edges around ends of said snowboard; and wherein said carbon fiber layer forms a topmost layer of said snowboard.

12. The method of claim 11, further comprising:

bonding a first fiberglass cap to a first top end of said wood core;

bonding a second fiberglass cap to a second top end of said wood core; and bonding a carbon fiber support layer to said wood core and said first and second fiberglass caps.

13. The method of claim 11, further comprising:

forming said sintered base layer by heating and pressing plastic pellets under pressure to create a porous structure.

14. The method of claim 11, further comprising:

reducing epoxy content in said carbon fiber layer using an epoxy thinner to enhance flexibility of said snowboard.

15. A snowboard comprising:

a wood core;

a fiberglass support at both ends of said wood core;

a carbon fiber support layer bonded to a top of said wood core and said fiberglass support;

a carbon fiber top layer positioned as a topmost layer;

a sintered base layer as a bottommost layer; and titanium reinforced edges surrounding the ends of said snowboard.

* * * * *